US008375495B2

(12) United States Patent
Kim et al.

(10) Patent No.: US 8,375,495 B2
(45) Date of Patent: Feb. 19, 2013

(54) CONTROL METHOD OF LAUNDRY MACHINE

(75) Inventors: Pyoung Hwan Kim, Changwon-si (KR); Eun Jin Park, Changwon-si (KR); Dong Woo Kang, Changwon-si (KR); Myoung Suk You, Changwon-si (KR); Deug Hee Lee, Changwon-si (KR); Kyu Won Lee, Changwon-si (KR); Hyung Yong Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 914 days.

(21) Appl. No.: 12/432,391

(22) Filed: Apr. 29, 2009

(65) Prior Publication Data

US 2010/0050345 A1 Mar. 4, 2010

(30) Foreign Application Priority Data

Apr. 30, 2008 (KR) ..... 10-2008-0040319
Apr. 17, 2009 (KR) ..... 10-2009-0033535

(51) Int. Cl.
*D06F 33/00* (2006.01)

(52) U.S. Cl. ..... 8/159

(58) Field of Classification Search ..... 8/158, 159; 68/12.18, 17 R
See application file for complete search history.

(56) References Cited

U.S. PATENT DOCUMENTS 5,083,447 A * 1/1992 Kiuchi et al. ..... 68/12.05
5,134,867 A * 8/1992 Kiuchi et al. ..... 68/12.02
5,136,861 A * 8/1992 Kiuchi et al. ..... 68/12.04
5,140,842 A * 8/1992 Kiuchi et al. ..... 68/12.02
5,438,507 A * 8/1995 Kim et al. ..... 700/1
5,644,936 A * 7/1997 Yasutake et al. ..... 68/12.02
2003/0106164 A1* 6/2003 Metzger-Groom et al. ..... 8/158
2004/0236522 A1 11/2004 Howes, Jr. et al.
2005/0022317 A1* 2/2005 Shaffer ..... 8/159
2006/0248658 A1 11/2006 Ha et al.

FOREIGN PATENT DOCUMENTS

CN 1566437 A 1/2005
EP 0383218 A1 8/1990
FR 2412638 A1 7/1979
FR 2 883 890 A1 10/2006
GB 2266898 A 11/1993
RU 2315141 C2 1/2008

OTHER PUBLICATIONS

Machine translation of FR 2883890 A1, no date.*
Machine (EPO/Google) translation of FR 2883890.*

* cited by examiner

*Primary Examiner* — Joseph L Perrin
(74) *Attorney, Agent, or Firm* — Birch, Stewart, Kolasch & Birch, LLP

(57) ABSTRACT

A control method of a laundry machine comprising a water supply, washing and rinsing cycle, the control method includes first determination step performed prior to the rinsing cycle and determining a kind of detergent, second determination step performed during a first rinsing course of the rinsing cycle and determining an amount of remained detergent in a rinsing water, and condition determination step of at least one following rinsing course based on the kind and amount of the remained detergent.

10 Claims, 5 Drawing Sheets

CONTROL METHOD OF LAUNDRY MACHINE

CROSS REFERENCE TO RELATED APPLICATION

This application claims the benefit of the Patent Korean Application Nos. 10-2008-040319, filed on Apr. 30, 2008 and 10-2009-0033535, filed on Apr. 17, 2009, which are hereby incorporated by reference as if fully set forth herein.

BACKGROUND OF THE DISCLOSURE

1. Field of the Disclosure

The present invention relates to a control method of a laundry machine.

2. Discussion of the Related Art

Laundry machines are typically electric appliances capable of removing soil in laundry, for example, clothes, cloth items, beddings and the like to clean the laundry, using physical and chemical action between detergent and water supplied to a tub. Important elements to determine washing efficiency of such the laundry machines may be the temperature of water and the amount of detergent.

However, according to a conventional laundry machine, it is difficult to measure the amount of remained detergent in the laundry machine.

SUMMARY OF THE DISCLOSURE

The present invention is directed to a laundry machine.

An object of the present invention is to provide a control method of a laundry machine performing overall operation in an optimal washing or rinsing pattern according to the amount of detergent dissolved in wash water.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control method of a laundry machine comprising a water supply, washing and rinsing cycle, the control method includes first determination step performed prior to the rinsing cycle and determining the kind of detergent; second determination step performed during the rinsing cycle and determining the amount of detergent; and rinsing condition determination step determining at least one rinsing condition based on the kind and amount of detergent determined in the first and second determination step.

The second determination step may be performed after a rinsing course of the rinsing cycle is performed one time. The first determination step may be performed during the washing cycle. Here, the first determination step may measure conductivity of wash water and may determine the kind of detergent based on the measured conductivity.

The first determination step may determine that supplied detergent is powder detergent in case the measured conductivity is over a preset value and that supplied detergent is liquid detergent in case the measured conductivity is below the preset value.

In case the first determination step determines that the supplied detergent is powder detergent, the second determination step may include measuring conductivity of wash water; and calculating the amount of detergent based on the measured conductivity of wash water.

The rinsing condition determination step may determine the number of following rinsing courses based on the measured amount of detergent.

Thee measured conductivity may be compensated according to the temperature of wash water.

The control method of the laundry machine according to the present invention may further include conductivity measuring step measuring conductivity of wash water containing no detergent to compensate the conductivity according to hardness of wash water.

The conductivity measuring step measuring the conductivity of wash water containing no detergent may include measuring a first conductivity of wash water containing no detergent during the water supply cycle; measuring a second conductivity of wash water containing no detergent during the last rinsing course of the rinsing cycle; and storing an average value of the first and second conductivity if difference between the first and second conductivity is below a preset value and deleting the measured first and second conductivity and re-storing a conductivity value stored prior if the difference is over the preset value.

The conductivity measuring step measuring the conductivity of wash water containing no detergent may include measuring a first conductivity of wash water containing no detergent during the water supply cycle; measuring a second conductivity of wash water containing no detergent during the last rinsing course of the rinsing cycle; and comparing the first conductivity and the second conductivity and storing a smaller one of the two conductivity values.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIG. 1 is a sectional view illustrating a laundry machine a control method according to an exemplary embodiment is applicable to;

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

In reference to the drawings, a laundry machine according to an exemplary embodiment will be described first and the control method will be described in detail later.

Figure 1:
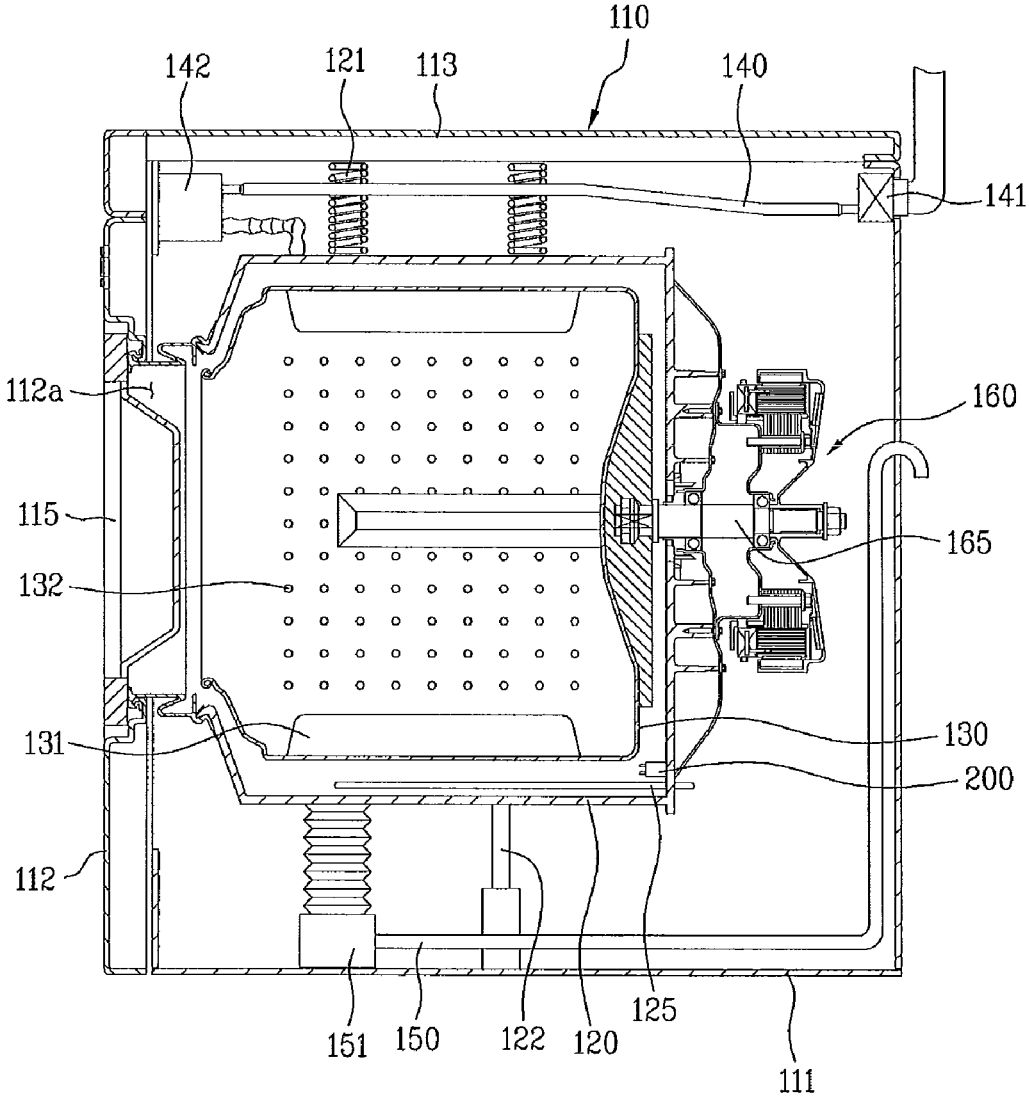

FIG. 1 is a sectional view illustrating a laundry machine a control method according to an exemplary embodiment is applicable to.

Referring to FIG. 1, the laundry machine includes a cabinet 10, a tub 120, a drum 130 and a conductivity sensor 200. The cabinet 10 defines an exterior appearance of the laundry machine. The tub 120 is provided in the cabinet 10 and water is accommodated in the tub 120. The drum 130 is rotatably provided within the tub 120. The conductivity sensor 200 measures conductivity of water.

The cabinet 10 may include a body 111, a front plate 112 and a top plate 113. The body 111 forms a side, rear and bottom surface of the cabinet 110. The front plate 112 forms a front surface of the cabinet 10 and the top plate 113 is coupled to a top of the body 111 to form a top cover of the body 111. An opening 112*a* is provided in the front plate 112 forming the front of the cabinet 110. The laundry may be loaded via the opening 112*a* and a door 115 is rotatably coupled to the opening 112*a* to close the opening 112*a*.

A top of the tub 120 is supported to the top of the cabinet 110 by a hanging spring 121 and a bottom of the tub 120 is supported by a damper 122.

A lifter 131 is provided in an inner circumferential surface of the drum 130 and the lifter 131 lifts the laundry loaded into the drum 130 to a predetermined position. A plurality of through holes 132 are formed in the inner circumferential surface of the drum 130 and water is drawn or discharged into or from the drum 130 via the through holes 132.

A water supply hose, a water supply valve 141 and a detergent supply device 142 may be provided beyond the tub 120. Water is supplied to the tub 120 from an external water supply source via the water supply hose 140. The water supply valve 141 is provided in the water supply hose 140 to control water flow. The detergent supply device 142 receives and supplies detergent to the tub 120, together with the water supplied via the water supply hose 140. A water drain hose 150 and a water drain pump 151 may be provided blow the tub 120 to drain the water used in a washing and rinsing cycle outside.

In the meanwhile, a motor 160 is mounted in a rear of the tub 120 and the motor 160 is connected with the drum 130 through a rotational shaft 165 to rotate the drum 130.

A heater 125 and a temperature sensor (not shown) are provided in a lower portion of the tub 120. The heater 125 heats water and the temperature sensor the temperature of the water. The laundry machine turns on the heater 125 according to a user's selection and it heats water.

As mentioned above, the laundry machine includes the conductivity sensor for sensing conductivity of water and it will be described in detail as follows.

Figure 2:
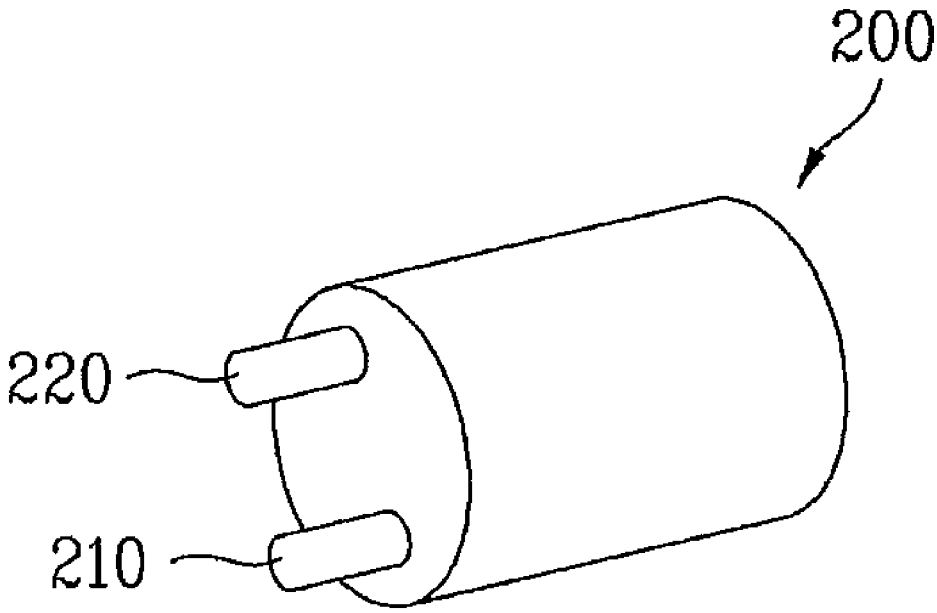
FIG. 2 is a perspective view illustrating a conductivity sensor provided in the laundry machine shown in FIG. 1.

FIG. 2 is a perspective view illustrating the conductivity sensor.

Referring to FIGS. 1 and 2, the conductivity sensor 200 includes two conductive pieces 210 and 220 spaced apart a predetermined distance from each other to contact with water. Once water is fulfilled between the two conductive pieces 210 and 220, conductivity of water may be measured. The conductivity of water may influenced by ions dissolved in the water. If detergent is dissolved in water, ions are formed enough to increase conductivity of water. As hardness of water increases, it can be determined that more ions are included in the water and thus the conductivity of the water increases.

As follows, a control method of the laundry machine having the above configuration will be described.

Figure 3:
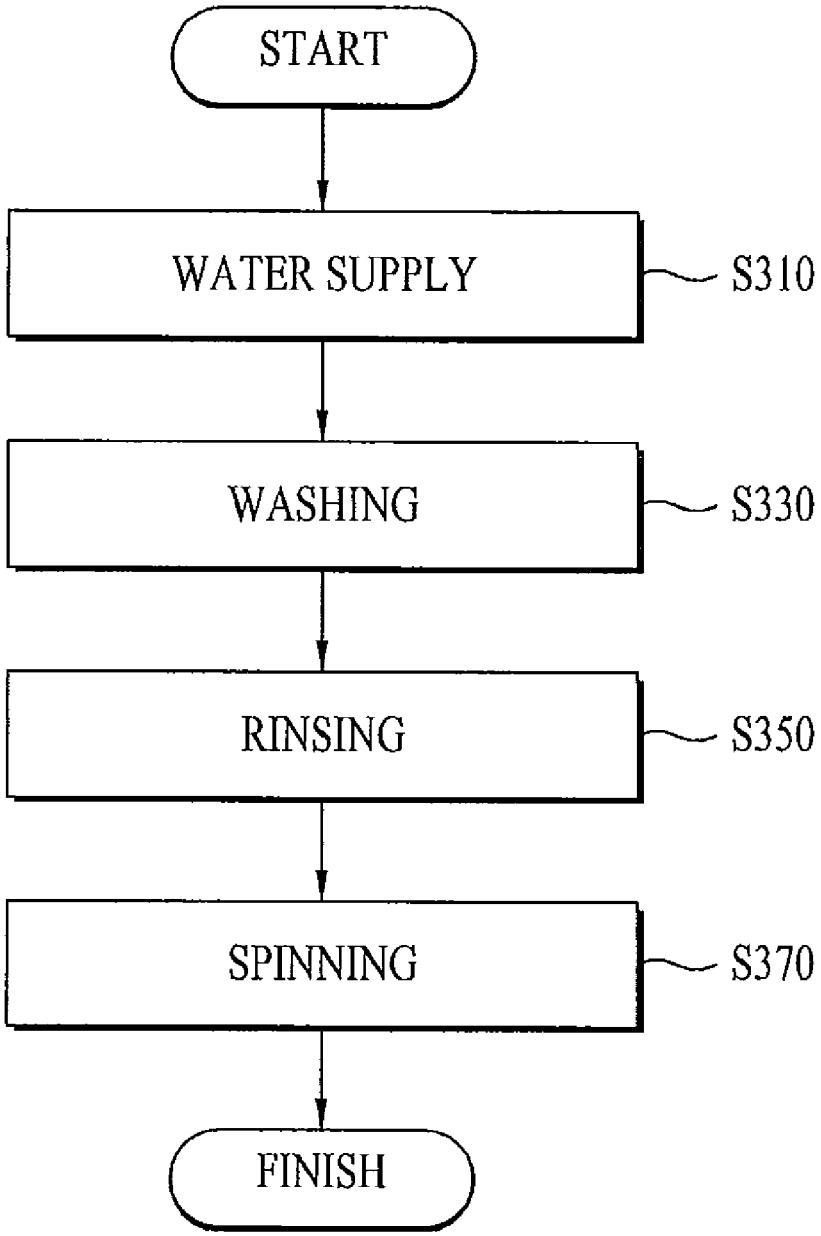
FIG. 3 is a flow chart illustrating the control method according to the exemplary embodiment of the present invention.

FIG. 3 is a flow chart schematically illustrating an operational flow of the laundry machine.

In reference to FIG. 3, the control method of the laundry machine includes a water supply cycle (S310), washing cycle (S330), rinsing cycle (S350) and spinning cycle (S370).

However, a conventional rinsing cycle of the conventional laundry machine is performed according to the user's selection, regardless of the amount of remained detergent. As a result, in case small detergent is supplied, rinsing course of the preset rinsing cycle would be performed many times unnecessarily and in case much detergent is supplied, the rinsing course would be performed too little times.

If the rinsing course is performed too many times in comparison to the amount of the remained detergent, much water and electricity would be consumed and this could lead to energy waste. In addition, if the rinsing course is performed too little times in comparison to the amount of the remained detergent, an overall course of the laundry machine finishes in a state of detergent remaining in the laundry and thus the user would feel unsatisfied with the laundry machine.

Such the disadvantage may occur with respect to the kind of the detergent as well as to the amount of the remained detergent. In case of using liquid detergent in comparison to powder detergent, the rinsing course is required to be performed more times.

Thus, according to this embodiment of the control method, the kind and the amount of remained detergent may be sensed and at least one rinsing condition, for example, the rinsing time or the number of rinsing courses may be determined based on the result of the sensing. Once the rinsing cycle finishes, remaining detergent in the laundry may be prevented as much as possible.

In the meanwhile, according to the control method of the present invention, conductivity of water is measured by the conductivity sensor mentioned above and the kind and amount of remained detergent are determined based on the sensed conductivity. This configuration will be described in detail as follows.

Figure 4:
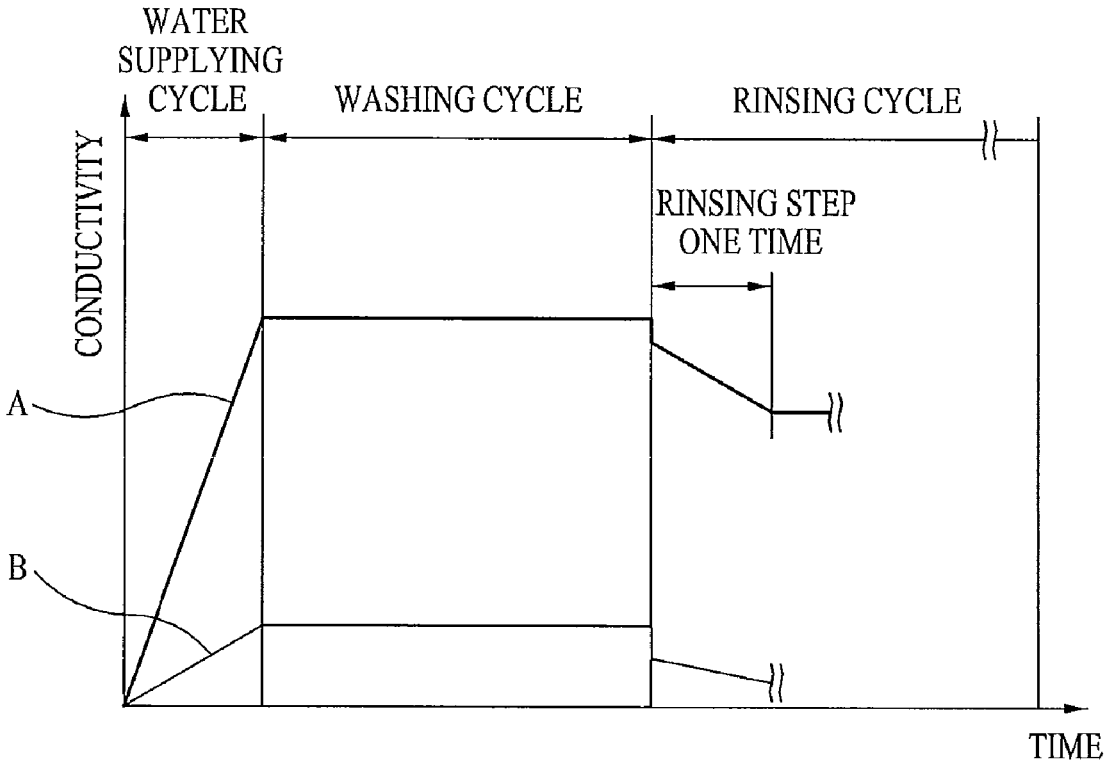
FIG. 4 is a graph illustrating changes of conductivity of wash water according to operation of the laundry machine.

FIG. 4 is a graph schematically illustrating changes of water conductivity during the operation of the laundry machine. This graph shows the conductivity of water, and conductivity of water in a spinning cycle is omitted.

First of all, changes of conductivity according to the operation of the laundry machine will be described and the control method the present invention that uses the changes of conductivity will be described later.

Referring to FIG. 4, water is supplied to the tub 120 in a water supply cycle and detergent starts to be dissolved in the water simultaneously. As the time passes in the water supply cycle, detergent is dissolved in water and the conductivity of the water increases.

Here, the increase of conductivity may be different according to which detergent is supplied liquid or powder. Generally, particles of powder detergent (A) have large ionization degree. When powder detergent is dissolved in water, conductivity of water is substantially large.

Hence, in a washing cycle, the drum 130 rotates selectively in a clockwise and counter-clockwise direction only to detach foreign substances and soil in the laundry. At this time, the conductivity of the washing water is maintained to a predetermined level almost uniformly.

Once a rinsing cycle starts after the washing cycle, the conductivity of the rinsing water decreases. This is because detergent contained in the rinsing water is removed during the rinsing course of the rinsing cycle.

In case the conductivity of water is changes during the operation of the laundry machine, the control method according to the present invention includes a first determination step, a second determination step and a condition determination step. In the first determination step, the kind of detergent is determined. In the second determination step, the amount of remained detergent is determined. In the condition determination step, at least one rinsing condition of at least one following rinsing course is determined based on the kind and amount of the remained detergent.

Here, the first determination step is performed prior to the rinsing cycle and it is envisioned that the first determination step is performed in the washing cycle.

Specifically, the first determination step senses the conductivity of washing water to determine the kind of detergent.

Figure 5:
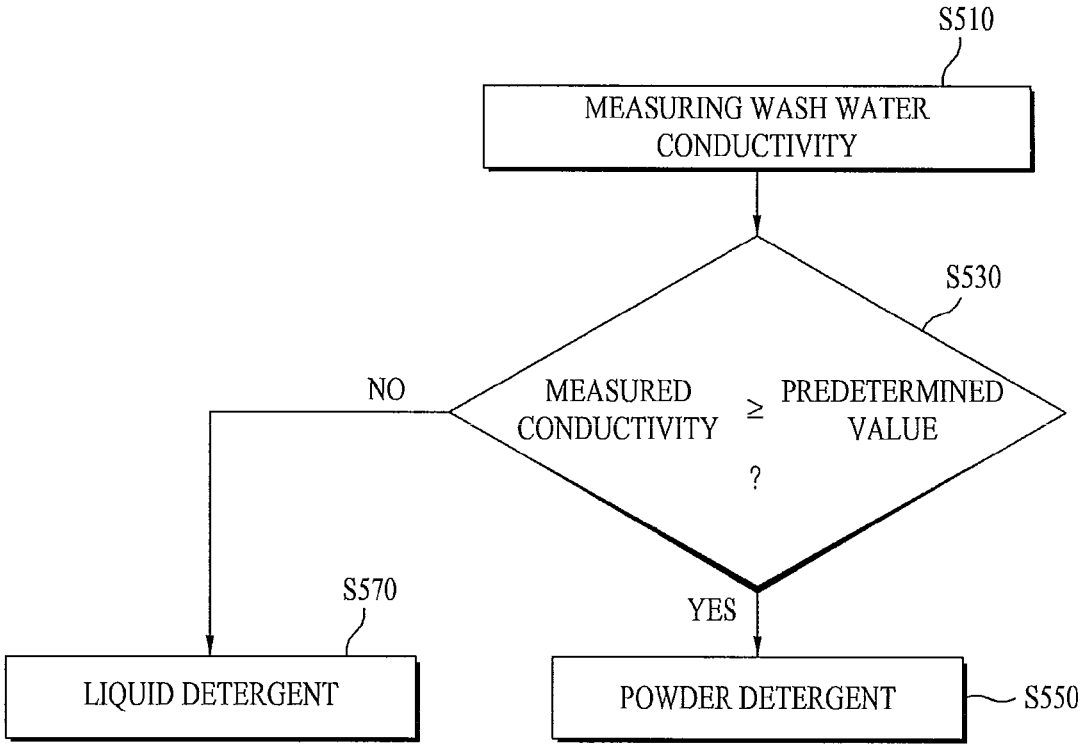
FIG. 5 is a flow chart illustrating a step of determining the kind of detergent.

FIG. 5 is a flow chart illustrating the determination step determining the kind of detergent.

As mentioned above, powder detergent increases the conductivity of washing water largely in comparison to liquid detergent. Thus, as shown in FIG. 5, the conductivity of washing water is sensed in a predetermined period of the washing cycle (S510) and the sensed conductivity is compared with a predetermined value (S530). If the sensed conductivity of the washing water is above the predetermined value, it is determined that powder detergent is supplied (S550). If the sensed conductivity is below the predetermined value, it is determined that liquid detergent is supplied (S570).

The amount of remained detergent is determined after the kind of detergent is determined. In the second determination step, conductivity of rinsing water during the rinsing cycle is sensed. It is envisioned that the conductivity of rinsing water is sensed during a first rinsing course.

More particularly, the conductivity of rinsing water may be sensed at the end of the first rinsing course. In other words, the conductivity of rinsing water may be sensed right before the first rinsing course is finished. Alternatively, the conductivity of rinsing water may be sensed prior to the end of the first rinsing course with a predetermined time period.

This is because detergent could be removed after at least one time of the rinsing course regardless of a large or small amount of detergent. In addition, the ratio of the detergent removal may be changeable according to laundry amount, water temperature and water amount in case the rinsing course is performed one time. As a result, if the amount of remained detergent of rinsing water is determined during the first rinsing course, it is possible to determine the amount of remained detergent precisely.

Specifically, the second determination step may include measuring the conductivity of rinsing water and calculating the amount of remained detergent based on the measured conductivity. Here, the amount of remained detergent may be determined by using data preset in a control part (not shown). That is, input data of amount of remained detergent corresponding to various values of rinsing water conductivity, respectively, is preset in the control part. Then, a value of the amount of remained detergent corresponding to the measured rinsing water conductivity is read and the amount of remained detergent is calculated. Such the data may include powder detergent data and liquid detergent data.

Hence, at least one rinsing condition is determined based on the kind and amount of remained detergent. In case of the determining the rinsing conditions, the control part may determine a water level of the rinsing cycle, the operation time of the rinsing cycle, the number of following rinsing courses and the like. According to this embodiment, the number of the following rinsing courses may be determined.

Thus, the number of the following rinsing courses is determined appropriately according to the amount of remained detergent. That is, the more is the amount of remained detergent, the more times the following rinsing courses are performed.

According to this embodiment of the control method, a third determination step may be further provided and it is determined according to the conductivity of supplied water whether the detergent is supplied.

The third determination step may be performed during the water supply cycle. Specifically, the control part senses conductivity of supplied water for a predetermined time period during the water supply cycle. If the conductivity changes for the predetermined time period, it is determined that detergent is contained in the supplied water. If the conductivity does not change for the predetermined time period, it is determined that no detergent is contained in the supplied water. In case determining no detergent, the control part may inform the user of no detergent by using a display part (not shown) or alarm sound. If the laundry machine includes a non-detergent course, the non-detergent course may be performed.

As mentioned above, the control method of the present invention determines the kind of detergent by sensing the conductivity of washing water and the amount of remained detergent by sensing the conductivity of rinsing water. At this time, the conductivity of washing water and rinsing water may have different values according to the temperature of washing water and rinsing water even with the identical kind and amount of detergent. To determine the kind and the amount of remained detergent precisely, it is envisioned that the conductivity of washing water and rinsing water is compensated according to the temperature of washing water and rinsing water. The step measuring the conductivity of washing water and rinsing water mentioned above may include compensating the conductivity of washing water and rinsing water according to the measured temperature of washing water and rinsing water.

For example, the temperature sensor mentioned above measures the temperature of washing water and rinsing water and conductivity corresponding to the measured temperature is compensated to a conductivity value corresponding to a reference temperature. The above-mentioned temperature compensating is performed by a data table that changes conductivity value of measured temperature into a conductivity value of a reference temperature.

In addition, the conductivity of washing water and rinsing water may be changeable according to hardness of water supplied to the laundry machine. As mentioned above, the higher is the hardness of supplied water, the more ions are contained in the supplied water such that the conductivity of water may increase. Because of that, it is envisioned that the conductivity of washing water and rinsing water is compensated according to the hardness of water supplied to the laundry machine. For example, the hardness of supplied water is measured by the conductivity sensor, and the measured conductivity is compensated and changed into a conductivity value corresponding to a reference hardness. Here, the hardness of supplied water may be calculated based on the measured conductivity value.

Specifically, in case the conductivity is compensated according to the hardness of supplied water, it is envisioned that conductivity of supplied water containing no detergent is measured. The conductivity of supplied water containing no detergent should be measured so as to calculate conductivity of pure water.

Here, the step measuring the conductivity of supplied water containing no detergent includes measuring a first conductivity of supplied water with no detergent in the water supply cycle, measuring a second conductivity of supplied water with no detergent in the rinsing cycle and storing the conductivity of supplied water according to the first and second conductivity.

The conductivity of supplied water with no detergent would be measured one time and compensated. However, the hardness of supplied water would changes according to the time, because it takes one or two hours to complete the operation of the laundry machine. As a result, the first conductivity of supplied water with no detergent is sensed primarily during an initial period of the operation of the laundry machine, that is, the water supply cycle. The second conductivity of supplied water with no detergent is sensed secondarily during a last period of the operation of the laundry machine, that is, the last rinsing course of rinsing cycle. Hence, the conductivity may be compensated according to the first and second conductivity. This will be described in detail as follows.

The first conductivity of supplied water with no detergent may be sensed during the water supply cycle. If water is supplied to a preliminary detergent space of the detergent supply device 142 where no detergent is received, only pure water is supplied to the tub 120 and the first conductivity may be measured.

The second conductivity of supplied water with no detergent may be sensed during the rinsing cycle. It is envisioned that conductivity of water supplied to the tub 120 during the last rinsing course of the rinsing cycle is measured. It is envisioned that this second conductivity measurement may be performed right after water supply for the last rinsing course. Therefore the conductivity of water supplied for the rinsing course not mixed with detergent can be measured.

After measuring the first and second conductivity of the supplied water with no detergent, the laundry machine compares the first conductivity with the second conductivity and it stores a smaller one of the two conductivity values. After storing the smaller one of the two values, the control part compensates the measured conductivity based on the stored conductivity of supplied water with no detergent when the laundry machine operates later.

There would be a kind of detergent that influences the hardness of supplied water little. In this case, the control part compares a difference between the first measured conductivity and the second measured conductivity with a preset value. If the conductivity difference is below the preset value, the control part stores an average value of the first and second conductivity. If the conductivity difference is over the preset value, the measured first and second conductivity is deleted and a conductivity value stored in the control part before is re-used.

That is, if the difference between the first and second conductivity is below the preset value, it is determined that the difference is trustworthy and the average value of the first and second conductivity is stored. In contrast, if the difference is over the preset value, it is determined that the difference is not trustworthy and the measured values are deleted and the conductivity value stored in the operation course performed prior is re-used.

The above control method of adjusting the rinsing conditions of the rinsing cycle by the sensing the kind and amount of remained detergent may be applicable variously. For example, the above control method may be performed by default in a normal course of the laundry machine and it may be performed in the other courses by the user's selection.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A control method of a laundry machine comprising a water supply cycle, a washing cycle and a rinsing cycle, the control method comprising:

a first determination step performed prior to the rinsing cycle and determining a kind of detergent;

a second determination step performed during a first rinsing course of the rinsing cycle and determining an amount of remained detergent in a rinsing water;

a condition determination step of at least one following rinsing course based on the kind and amount of the remained detergent;

a conductivity measuring step measuring conductivity of supplied water containing no detergent to compensate the conductivity of the rinsing water based on hardness of the supplied water, wherein the second determination step comprises:

measuring conductivity of the rinsing water; and calculating the amount of the remained detergent based on the measured conductivity of the rinsing water, and wherein the conductivity measuring step measuring the conductivity of the supplied water containing no detergent comprises:

measuring a first conductivity of the supplied water during the water supply cycle;

measuring a second conductivity of the supplied water during a last rinsing course of the rinsing cycle; and storing an average value of the first and second conductivity if a difference between the first and second conductivity is below a preset value or deleting the measured first and second conductivity and re-using a conductivity value stored prior if the difference is over the preset value.

2. The control method of claim 1, wherein the second determination step is performed prior to an end of the first rinsing course.

3. The control method of claim 1, wherein the first determination step is performed during the washing cycle, and conductivity of washing water is measured and the kind of detergent is determined based on the measured conductivity.

4. The control method of claim 1, wherein, in the first determination step, it is determined that the detergent is powder detergent when the measured conductivity is over a preset value and that the detergent is liquid detergent when the measured conductivity is below the preset value.

5. The control method of claim 1, wherein, in the condition determination step, the number of the at least one following rinsing course is determined based on the calculated amount of remained detergent.

6. A control method of a laundry machine comprising a water supply cycle, a washing cycle and a rinsing cycle, the control method comprising:

a first determination step performed prior to the rinsing cycle and determining a kind of detergent;

a second determination step performed during a first rinsing course of the rinsing cycle and determining an amount of remained detergent in a rinsing water;

a condition determination step of at least one following rinsing course based on the kind and amount of the remained detergent;

a conductivity measuring step measuring conductivity of supplied water containing no detergent to compensate the conductivity of the rinsing water based on hardness of the supplied water, wherein the second determination step comprises:

measuring conductivity of the rinsing water; and calculating the amount of the remained detergent based on the measured conductivity of the rinsing water, and wherein the conductivity measuring step measuring the conductivity of the supplied water comprises:

measuring a first conductivity of the supplied water during the water supply cycle;

measuring a second conductivity of the supplied water during a last rinsing course of the rinsing cycle; and comparing the first conductivity and the second conductivity and storing a smaller one of the two conductivity values.

7. The control method of claim 6, wherein the second determination step is performed prior to an end of the first rinsing course.

8. The control method of claim 6, wherein the first determination step is performed during the washing cycle, and conductivity of washing water is measured and the kind of detergent is determined based on the measured conductivity.

9. The control method of claim 6, wherein, in the first determination step, it is determined that the detergent is powder detergent when the measured conductivity is over a preset value and that the detergent is liquid detergent when the measured conductivity is below the preset value.

10. The control method of claim 6, wherein, in the condition determination step, the number of the at least one following rinsing course is determined based on the calculated amount of remained detergent.

* * * * *